US005732583A

United States Patent [19]

Itaya

[11] Patent Number: 5,732,583

[45] Date of Patent: Mar. 31, 1998

[54] WIRE FORMING APPARATUS

[75] Inventor: Ichiro Itaya, Tokyo, Japan

[73] Assignee: Kabushiki Kaisha Itaya Seisaku Sho, Tokyo, Japan

[21] Appl. No.: 565,281

[22] Filed: Nov. 29, 1995

[30] Foreign Application Priority Data

Dec. 22, 1994 [JP] Japan ..... 6-319949

[51] Int. Cl.[6] ..... B21F 35/02; B21F 3/10; B21F 3/02

[52] U.S. Cl. ..... 72/137; 72/138; 72/140

[58] Field of Search ..... 72/135, 137, 138, 72/140, 145, 452.4, 450, 446, 447

[56] References Cited

U.S. PATENT DOCUMENTS

| | | | |
|---|---|---|---|
| 4,424,695 | 1/1984 | Kirchhoff et al. | 72/128 |
| 4,476,702 | 10/1984 | Zangerle | 72/137 |
| 4,586,357 | 5/1986 | Allweier et al. | 72/137 |
| 4,947,670 | 8/1990 | Wu | 72/137 |
| 5,127,247 | 7/1992 | Baisch | 72/138 |
| 5,259,226 | 11/1993 | Itaya | 72/138 |
| 5,452,598 | 9/1995 | Cheng | 72/137 |

FOREIGN PATENT DOCUMENTS

| | | |
|---|---|---|
| 43 23 009 | 1/1994 | Germany . |
| 57-11743 | 1/1982 | Japan . |
| 59-92136 | 5/1984 | Japan . |
| 59-92138 | 5/1984 | Japan . |
| 6-23458 | 2/1994 | Japan . |

OTHER PUBLICATIONS

Bihler-transfer, Oct. 1994, Otto Bihler Maschinenfabrik GmbH u. Co., KG, pp. 1–8.

German trade journal *m+w*, Jahre VDW, May 1991, pp. 86, 88.

*Primary Examiner*—Lowell A. Larson
*Assistant Examiner*—Rodney Butler
*Attorney, Agent, or Firm*—Merchant, Gould, Smith, Edell, Welter & Schmidt, P.A.

[57] ABSTRACT

A circular table is provided around a wire forming portion. A plurality of forming tool units are disposed on the surface of this circular table such that they are directed to almost the central position (wire forming portion) of the table. Each forming tool unit is movable along guide grooves formed in the surface of the circular table, and its position can be fixed. Therefore, the entering direction of the forming tool mounted to the distal end of the forming tool unit can be arbitrarily changed. Independent servo motors are respectively mounted to the forming tool units, and they can be driven independently of each other.

8 Claims, 8 Drawing Sheets

WIRE FORMING APPARATUS

BACKGROUND OF THE INVENTION

The present invention relates to a wire forming apparatus and, more particularly, to a wire forming apparatus that forms a wire by curving or bending.

An example of an apparatus of this type includes a spring manufacturing apparatus.

In general, in a spring manufacturing apparatus, a wire is fed out to a spring forming portion by feed rollers, and the wire is subjected to various types of forming operations at the forming portion. For example, a wire is forcibly abutted against a tool called a point tool and curved, so that the wire is formed into a spring, or a wire is extended between a coiling shaft tool and a pawl portion provided to it, and the coiling shaft is rotated, so that the wire is formed into a spring.

To form the end portion of a spring, various types of tools are used, e.g., a tool for forming a hook, a tool for cutting, and the like.

Usually, these tools are radially arranged on a table located in the vicinity of a spring forming portion and substantially perpendicular to the wire feedout direction, about the forming portion as the center.

In a conventional apparatus of this type, a plurality of gears are disposed on the table about the forming portion as the center such that they mesh with each other, in order to transmit the drive force from one drive source to the respective tools. The pivot force of each gear is transmitted to a corresponding tool, thereby controlling the slide movement of the tool.

Some tools sometimes interfere with wire formation of a certain type. In other words, not all the disposed tools are always used for forming a wire, and some tools should not operate.

Conventionally, in this case, a slide for holding this non-required tool and a cam must be removed in order to make this tool inoperative.

However, most of the tools and respective members that regulate the operations of the tools are heavy as they are mostly made of a metal. This removing operation thus takes time and is cumbersome.

Furthermore, as the spring manufacturing apparatus has the above structure, a position where a tool is to be disposed must be selected from predetermined positions.

Various types of wire formations are demanded for a recent wire forming apparatus, e.g., a spring manufacturing apparatus. If a tool cannot be disposed but at the fixed position described above, it is difficult to satisfy the above demand.

SUMMARY OF THE INVENTION

The present invention has been made in view of the prior art technique described above, and has as its object to provide a wire forming apparatus in which whether or not each forming tool is to be operated can be easily set, and the position where the tool is to be disposed can be arbitrarily changed, so that the entering direction of the tool can be changed to desired directions.

In order to solve this problem, according to the present invention, there is provided a wire forming apparatus that forms a wire guided from a wire feedout guide by driving a plurality of forming tool units disposed on a table having a surface substantially perpendicular to a feedout direction of the wire, wherein the table has a substantially circular shape, and each of the plurality of forming tool units has locking means for changing and holding a position of the forming tool unit while the forming tool unit is directed toward a center of the table, an independent pivot drive source, a cam for converting a drive force sent from the pivot drive source into a drive force directed toward the center of the table, and a slider which abuts against the cam with a predetermined pressure, is slidable toward the center of the table, and is mounted with a wire forming tool.

In the above arrangement of the present invention, the respective tool portions are disposed on the circular table such that the tools are directed toward the center of the circular table. In this case, the positions of the respective forming tool units can be locked at arbitrary positions with locking means while they are directed toward the center of the table. The respective forming tool units are provided with independent drive sources, and the driving operations of the drive sources are converted into linear movements of the respective tools by the cams. In this manner, a desired tool can be entered in a desired direction to enable wire formation. A drive signal is not sent to a tool which is not used. Thus, a forming tool unit which is not used need not be removed and does not interfere with wire formation.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A preferred embodiment of the present invention will be described in detail with reference to the accompanying drawings.

Figure 1:
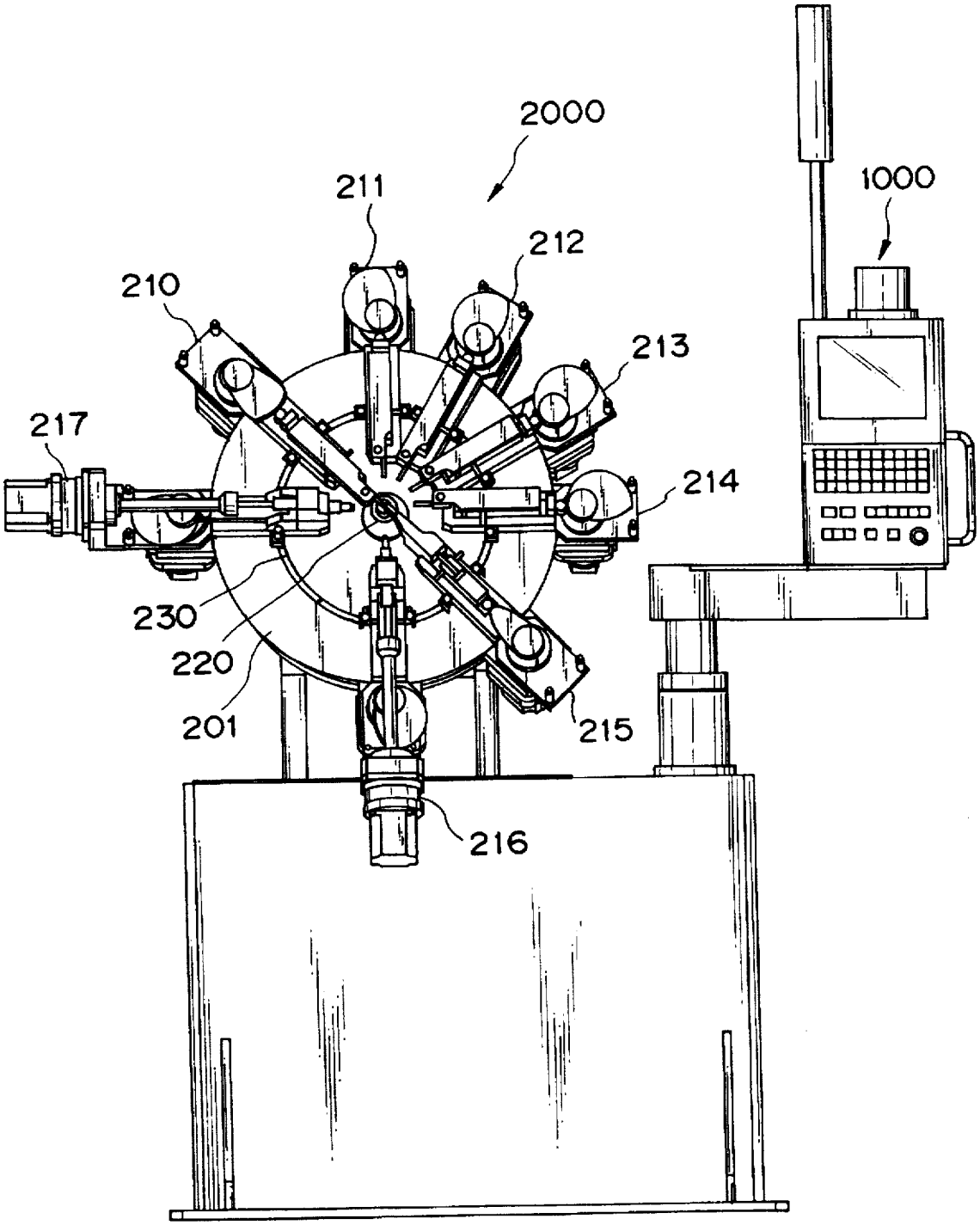
FIG. 1 is a front view of a wire forming apparatus according to an embodiment.
Figure 2:
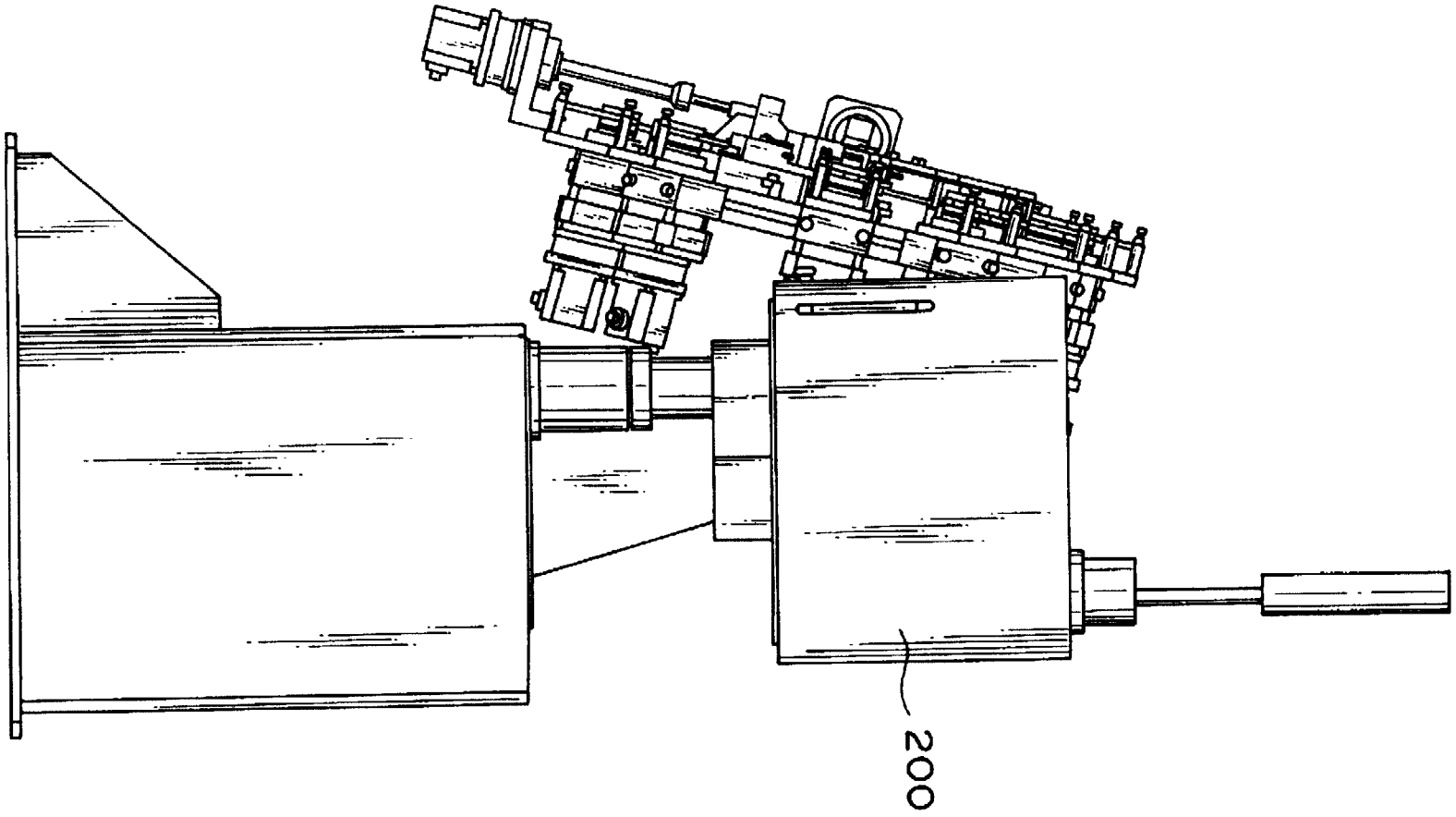
FIG. 2 is a side view of the wire forming apparatus according to this embodiment.

FIG. 1 is a front view of a wire forming apparatus according to an embodiment of the present invention, and FIG. 2 is a side view of the same.

Referring to FIGS. 1 and 2, reference numeral 1000 denotes a controller unit that controls the apparatus entirely; and 2000, a wire forming section that actually forms a wire.

In FIGS. 1 and 2, the wire forming section 2000 is mainly constituted by a disk-like table and forming tool units 210 to 217 disposed around a table 201. A hollow portion (hole) is formed at the central portion of the table 201, and a guide 220 that guides wire feedout from behind to the front of the surface of the sheet of FIG. 1 is located in this hole. The wire feedout operation is obtained by the driving operation of feed rollers (not shown) provided behind the surface of the sheet of FIG. 1.

Figure 3:
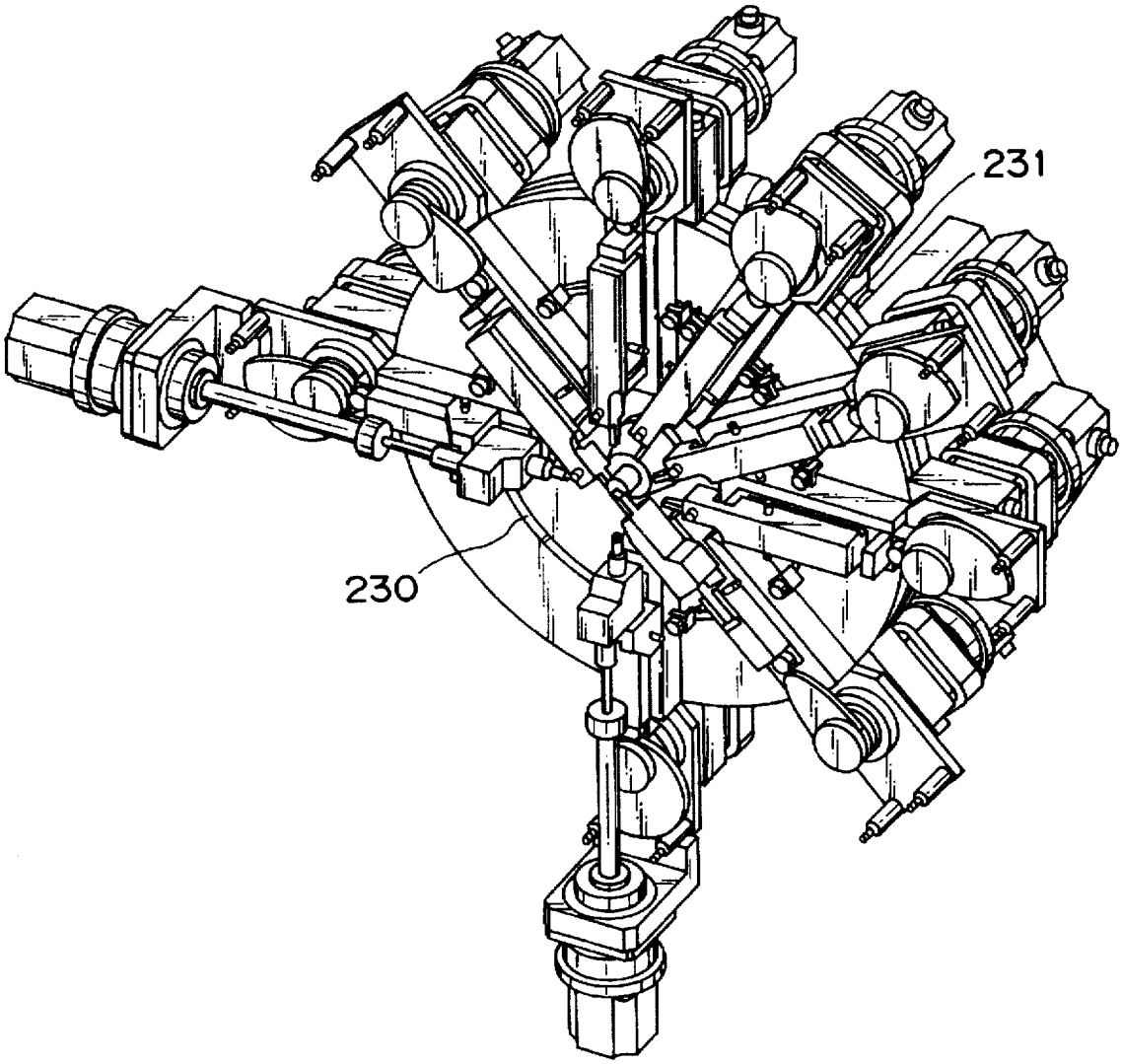
FIG. 3 is a perspective view of the forming portion of the wire forming apparatus according to this embodiment.

FIG. 3 shows the table 201 portion in detail.

As shown in FIG. 3, a guide groove 230 is formed in the surface of the table 201, and a guide groove 231 is formed in the outer circumferential surface of the table 201. The respective forming tool units 210 to 217 can be fixed at arbitrary positions along these guide grooves 230 and 231 with bolt mechanisms (or screw mechanisms) serving as the locking means provided to them. When the forming tool units 210 to 217 are fixed along the two grooves in this manner, their mounting positions can be stably maintained. Regarding the sectional shapes of the guide grooves, for example, both the guide grooves 230 and 231 have a T-shaped section, and portions of the locking means serving as the accepting portions of the bolts have shapes to match these grooves. Accordingly, even when the bolts are loosened, the forming tool units 210 to 217 do not immediately disengage from the table 201, and their positions can be freely changed as they are directed toward the center of the table 201. As shown in FIG. 2, the table 201 is inclined by a predetermined angle. Thus, even if a locking means is loosened in order to adjust the position of the corresponding forming tool unit, the position of this forming tool unit can be changed with a small force (due to the existence of the frictional force). Note that, for example, when the wire is cut in order to manufacture a spring, the manufactured spring falls. Thus, the angle of inclination of the table 201 is limited.

In FIG. 3, independent servo motors are mounted to the respective forming tool units 210 to 217. Cams having shapes appropriate for the operations of the forming tools (tools for cutting, bending, coiling, or curving the wire by forcibly buffing the wire against them) mounted to the respective forming tool units are axially supported on the drive shafts of the respective servo motors (sometimes through several gears), so that the respective forming tools can perform their operations.

The controller unit 1000 drives the plurality of servo motors mounted to the respective forming tool units in a synchronous manner. The servo motor that drives the feed rollers for feeding out the wire is also controlled by the controller unit 1000.

Figure 4:
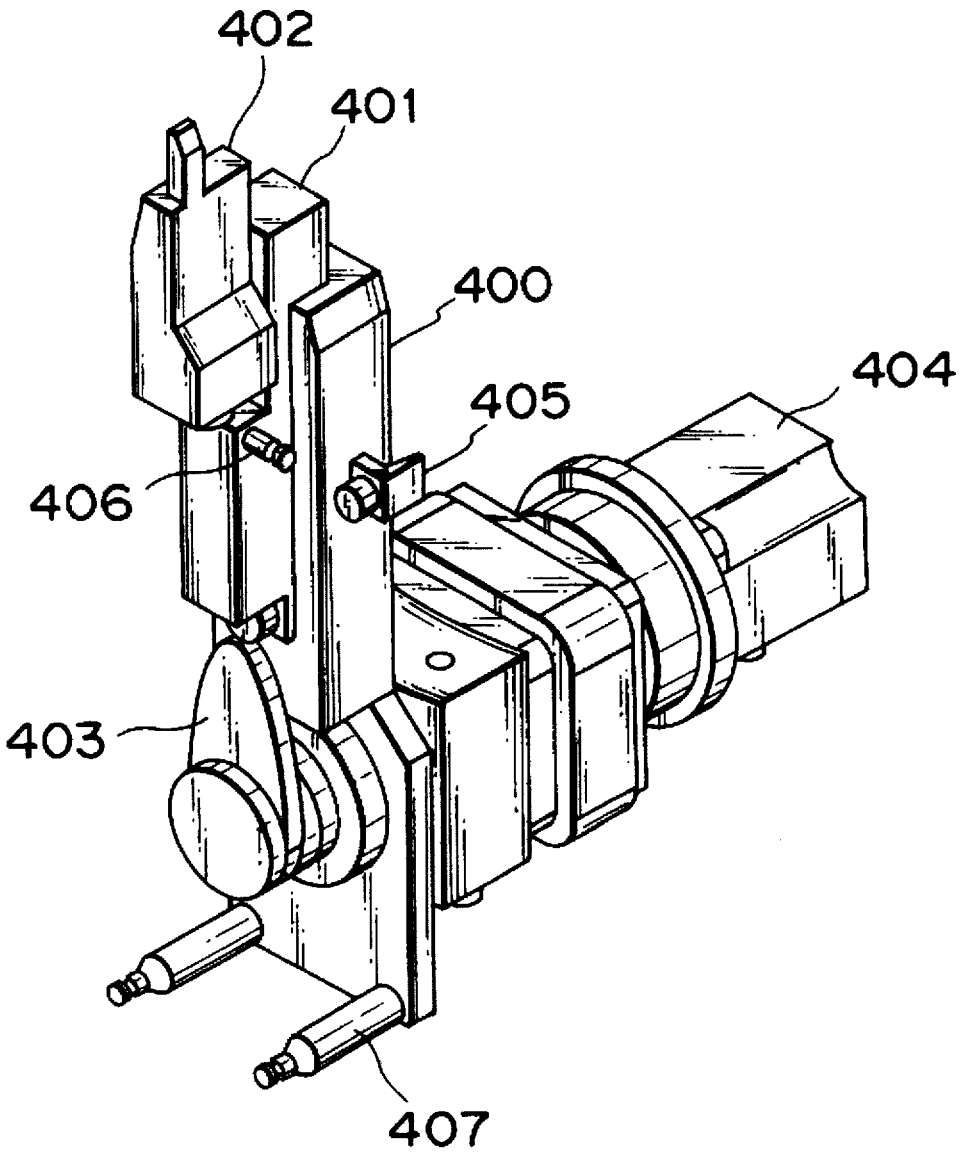
FIG. 4 shows an example of the structure of a forming tool unit used in this embodiment.
Figure 5:
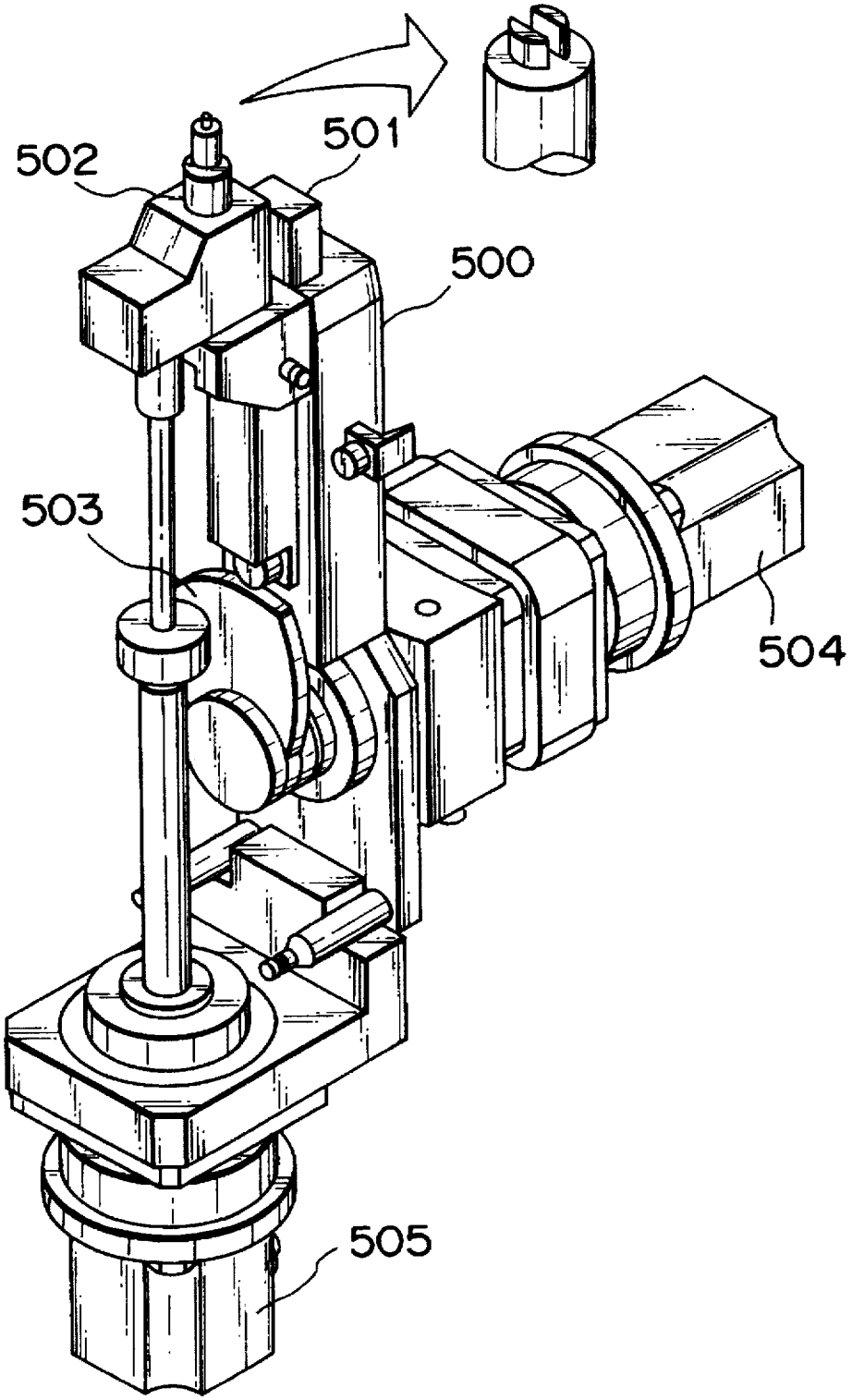
FIG. 5 shows an example of the structure of the forming tool unit used in this embodiment.

FIGS. 4 and 5 show examples of the forming tool unit, in which FIG. 4 shows a forming tool unit on which a tool (cutter) for cutting a wire is mounted, and FIG. 5 shows a forming tool unit on which a tool for bending a wire to have an arcuated portion is mounted.

Referring to FIG. 4, reference numeral 400 denotes a base portion of the forming tool unit. Constituent elements as follows are mounted or fixed to this base portion 400.

Reference numeral 401 denotes a slide base which is mounted to be slidable along a guide groove formed in the base portion 400 (note that this guide groove has a trapezoidal sectional shape so that the slide base 401 does not disengage from the base portion 400). A forming tool 402 is fixedly mounted to this slide base 401. A rotatable cam follower is provided to the rear end (lower end in FIG. 4) of the slide base 401. This rotatable cam follower is in contact with the side surface of a cam 403 in order to smoothen the operation of the slide base 401 which is caused by the pivot movement of the cam 403.

The rotation center shaft of the cam 403 is connected to the drive shaft of a servo motor 404 directly or indirectly through a plurality of gears.

The cam 403 has an elliptic shape in order to make the movement of the slide base 401 quick, as the forming tool 402 serves as a cutter.

With the above arrangement, when, e.g., the controller unit 1000 drives the servo motor 404, the cam 403 is rotated in an interlocked manner with the servo motor 404. As the slide base 401 is in contact with the cam 403, it is vertically moved along the groove formed in the base portion 400. As a result, the tool (cutting tool in this case) 402 mounted to the slide base 401 moves across a wire feedout guide (one provided at the central position of the table 201), thereby cutting the wire.

Although not particularly described above regarding FIGS. 1 to 3 and 4, for example, in FIG. 4, two poles 407 each for supporting one end of an extension spring are provided to the lower end (trailing end) of the base portion 400 of each forming tool unit, so that the slide base 401 forming tool unit abuts against the cam of the base portion 400 with a predetermined pressure. Also, projecting portions 406 (only one is shown in FIG. 4 as the other one is behind other constituent elements) each for supporting the extension spring are provided at the right and left symmetric positions of the slide base 401. The extension springs are set to extend between the poles 407 and the corresponding projecting portions 406 on the slider base 401.

Accordingly, although not particularly shown in FIGS. 1 to 3, extension springs are actually set to extend between the slide base and the base portion of each forming tool unit, and each slide base abuts against the side surface of the cam regardless of the direction of the corresponding forming tool.

FIG. 5 shows the structure of a forming tool unit on which a wire coiling tool is mounted. A tool of this type requires two mechanisms, i.e., a mechanism that guides the forming tool to a wire forming portion (this mechanism is identical to that of FIG. 4), and a bending mechanism. Hence, two servo motors are fixed to a base portion 500, as shown in FIG. 5. The base portion 500 has a groove for guiding a slide base 501, as shown in FIG. 5, and a coiling tool 502 is fixedly mounted to this slide base 501.

As shown in FIG. 5, a pair of projecting portions, that are spaced apart from each other by a distance that allows a wire to pass therethrough, are provided at the distal end of the coiling tool 502. After the wire is passed between these projecting portions, the coiling tool 502 is rotated, thereby bending the wire.

The principle with which the coiling tool 502 is guided to the wire forming portion is omitted as it is identical to that of FIG. 4. The bending operation of this forming tool unit is obtained by the drive of a servo motor 505 shown in FIG. 5. Accordingly, several gears and the like for transmitting the pivot force of the servo motor 505 are incorporated in the coiling tool 502.

The arrangement of FIG. 5 is a tool which is important in particular for forming a spring. Conventionally, the position of the spring forming tool is fixed. However, according to this arrangement, this tool can be set at an arbitrary position, thereby remarkably widening the application field.

Figure 12:
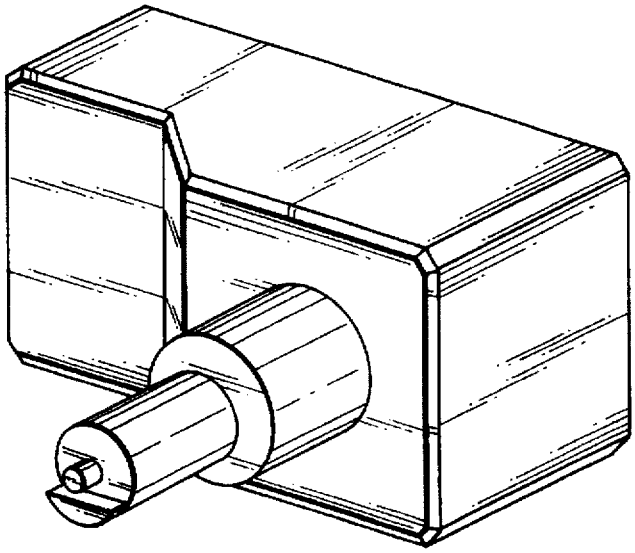
FIG. 12 shows still another shape of the attachment of the forming tool unit used in this embodiment and constituted by two motors.
Figure 11:
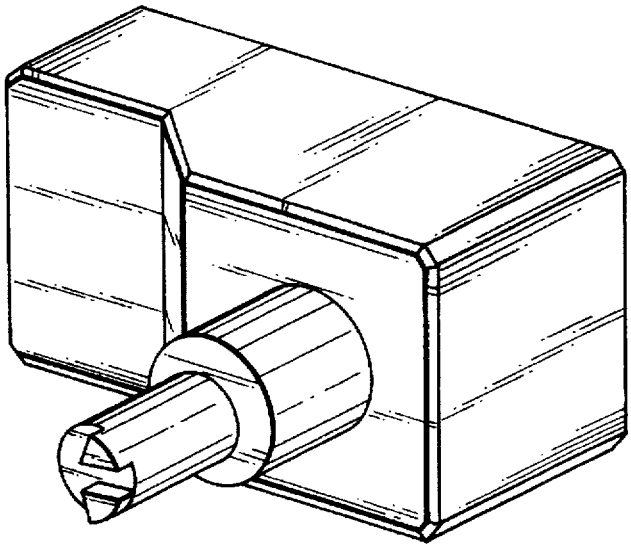
FIG. 11 shows still another shape of the attachment of the forming tool unit used in this embodiment and/constituted by two motors.
Figure 10:
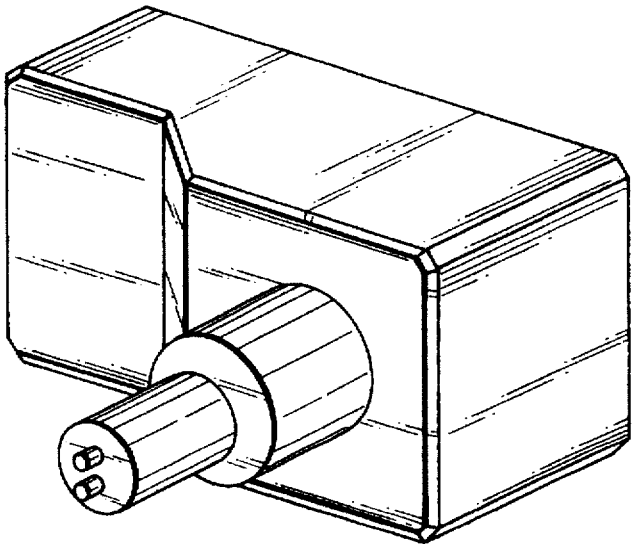
FIG. 10 shows another shape of the attachment of a forming tool unit used in this embodiment and constituted by two motors.

The shape of the distal end of the tool of FIG. 5 is not limited to this, and various shapes as shown in, e.g., FIGS. 10 to 12 can be employed.

For example, with the shape of FIG. 10, when this tool is pivoted, a wire can be curved to have a curvature. With the shape of FIG. 11, the tool operates to curve a wire to have a small curvature, that is, in a bending manner. With the shape of FIG. 12, when the pivot amount is small, the tool operates in the same manner as in FIG. 10. When the pivot amount is increased (e.g., 360° or more), the slide is moved backward, thereby forming a wire to have a plurality of turns, i.e., thereby manufacturing a spring, and the diameter of the second turn of the spring can be made larger than that of the first turn. Each of the respective tools shown in FIGS. 10 to 12 can be detachably mounted to the distal end of the forming tool unit shown in FIG. 5 (locked with a predetermined locking means so that it does not drop, as a matter of course), and these tools can be exchanged as required. With the tool of FIG. 12, when the length of a pole at its distal end is increased, a spring having a large number of turns, i.e., a spring having a large free length, can also be manufactured.

Note that the base portion 500 of FIG. 5 and the base portion 400 of FIG. 4 can employ the same structure. As a result, the unit price of a forming tool can be suppressed.

The cams are detachable and can be changed in accordance with the tools to be used. When a cam is used for driving (moving) a tool, for example, the control operation necessary for ejecting or retracting the tool at a constant speed (although not limited to a constant speed) becomes simple.

Figure 7:
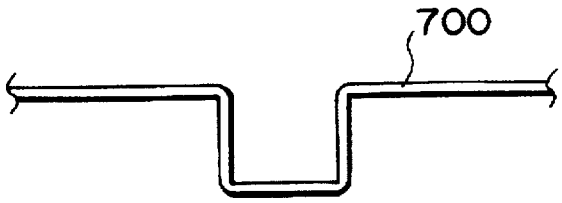
FIG. 7 shows an example of wire formation of this embodiment.

For example, when an intermediate portion of a wire is to be bent into a U-shape, as shown in FIG. 7, pressing that can form a wire at once is easier than bending the wire at respective bend positions.

Figure 8:
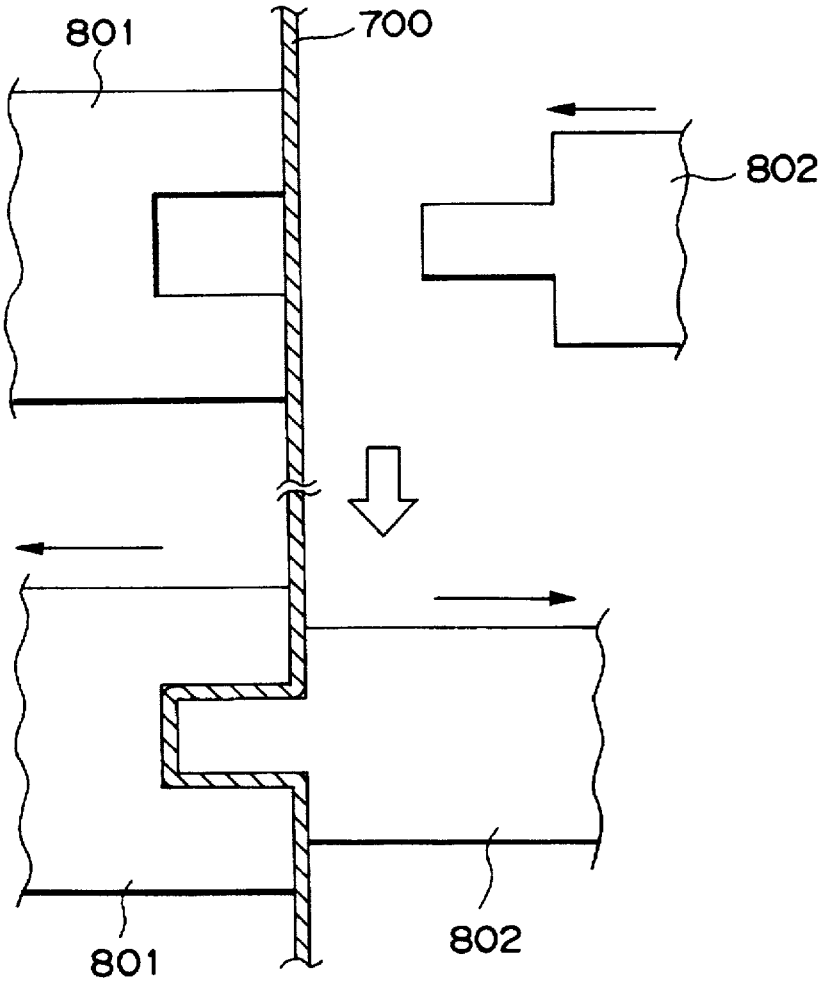
FIG. 8 shows an example of the process of wire formation of this embodiment.
Figure 9:
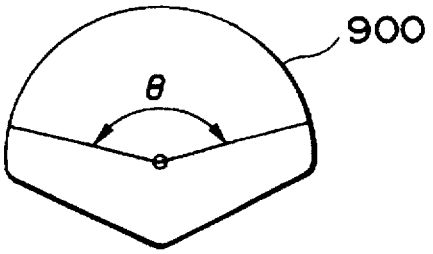
FIG. 9 shows the shape of the cam on the receiving side in press forming shown in FIG. 8.

In this case, the press-forming tool requires two forming tool units that have a phase difference of 180° between each other. The operation of these two forming tool units will be as shown in FIG. 8. More specifically, first, an accepting tool waits, and a pushing tool enters this accepting tool. In order to set the accepting tool in the waiting state, the servo motor may be stopped. However, a large load is sometimes imposed to the motor depending on the relationship between the slide base and the cam. For this reason, the cam to be mounted to the servo motor of the accepting tool is formed to partly have a circular arc corresponding to an angle of θ, as shown in FIG. 9, so that the accepting tool does not move in a range corresponding to this circular arc.

If the shape of the cam of the pushing tool is carefully designed, the above pressing can be performed only by controlling both the pushing and accepting tools completely in the same manner.

Figure 6:
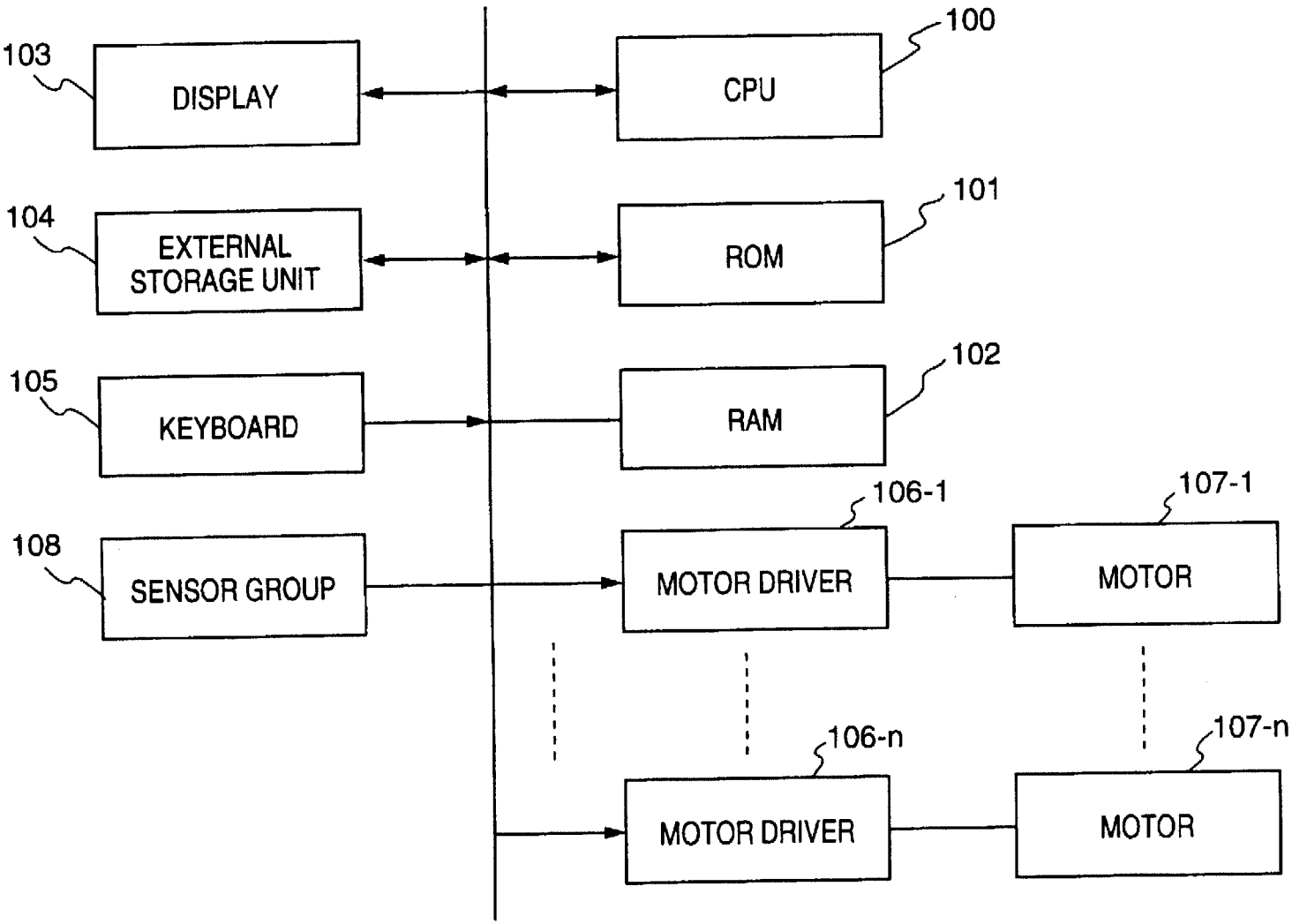
FIG. 6 is a block diagram of a controller unit of this embodiment.

FIG. 6 is a block diagram showing the relationship between the controller unit 1000 and the wire forming section 2000 of this embodiment.

Referring to FIG. 6, reference numeral 100 denotes a CPU; 101, a ROM; 102, a RAM; 103, a display; and 104, an external storage unit, e.g., a floppy disk drive. The CPU 100 controls this controller unit 1000 entirely. The ROM 101 stores the contents of the processing operations (program) of the CPU 100 and various types of font data. The RAM 102 is used as the work area of the CPU 100. The display 103 is used for performing various types of setting operations and displays the contents of the setting operations, the process of the manufacture, and the like in the form of graphs. The external storage unit 104 is used for externally supplying a program or to store the contents of the various types of setting operations necessary for wire formation. As a result, when parameters necessary for certain wire formation (e.g., if a spring is to be manufactured, the free length, diameter, and the like of the spring) are stored in the external storage unit 104, the same springs can always be manufactured by setting this floppy 104 and executing the program.

Reference numeral 105 denotes a keyboard for setting various types of parameters; and 108, a sensor group of various types of sensors.

Reference symbols 106-1 to 106-n are motor drivers for driving servo motors 107-1 to 107-n that are mounted to the forming tools described above.

With the above arrangement, the CPU 100 drives the motors of the respective forming tool units independently from each other, performs an input/output operation with the external storage unit 104, and controls the display 103 in accordance with commands input from the keyboard 105.

As described above, according to this embodiment, the forming tools that are radially disposed around wire forming portion can be adjusted at arbitrary positions on the circular table 201 while they are directed toward the central position of the table 201. Furthermore, when the respective forming tool units are driven by independent servo motors, various demands of the user can be met. In addition, since a forming tool which is not used does not operate unless a drive signal is output to its servo motor (this is set by the controller unit 1000), the cam and the like driven by this servo motor need not be removed.

This embodiment exemplifies a spring manufacturing apparatus as a wire forming apparatus. However, the present invention is not limited to this. When manufacturing one spring, several forming tools must be driven, as is known in the manufacture of the hook portion of a spring, a torsion spring, and the like. In this respect, the present invention sufficiently exhibits its effect when it is applied to a spring manufacturing apparatus.

As has been described above, according to the present invention, whether or not respective forming tools are to be operated can be set easily, and the positions of these tools can be arbitrarily changed, thus enabling various types of wire forming operations.

As many apparently widely different embodiments of the present invention can be made without departing from the spirit and scope thereof, it is to be understood that the invention is not limited to the specific embodiments thereof except as defined in the appended claims.

What is claimed is:

1. A wire forming apparatus for forming a wire guided in a feedout direction, said apparatus comprising:

a table having a substantially circular shape with a center and a surface substantially perpendicular to the feedout direction of the wire;

a plurality of forming tool units disposed on said table, each of said forming tool units including an independent pivot drive source creating a first drive force and a cam for converting the first drive force to a second drive force directed toward the center of said table, each of said forming tool units also including a wire forming tool and a slider for holding said wire forming tool, said slider abutting against said cam and being slideably moveable toward the center of the table, wherein each of said forming tool units being moveable about the center of said table to different circumferential locations on said table; and locking means for changing and holding a circumferential position of each of said forming tool units while keeping said each of said forming tool units directed toward the center of said table.

2. The apparatus according to claim 1, wherein at least one of said forming tool units comprises said independent pivot drive source including a first motor for driving said cam that operates said slider, and a second motor for pivoting said tool;

said tool being mounted to said slider and having a pair of projecting portions to sandwich the wire therebetween.

3. The apparatus according to claim 1, wherein said table is inclined upward at a predetermined angle against a direction of gravity.

4. The apparatus according to claim 1, wherein said apparatus is a spring manufacturing apparatus.

5. The wire forming apparatus according to claim 1, wherein said table has an edge and said locking means includes a first groove in said edge and a second groove in said surface of said table.

6. The apparatus according to claim 2, further comprising control means for controlling said motors provided to said forming tool units independently of each other.

7. A wire forming apparatus for forming a wire guided in a feedout direction, said apparatus comprising:

a table having a substantially circular shape with a center and a surface substantially perpendicular to the feedout direction of the wire;

a plurality of forming tool units disposed on said table, each of said forming tool units including an independent pivot drive source creating a first drive force and a cam for converting the first drive force to a second force directed toward the center of said table, each of said forming tool units also including a wire forming tool and a slider for holding said wire forming tool, said slider abutting against said cam and being slideably moveable toward the center of the table, wherein each of said forming tool units being moveable about the center of said table to different circumferential positions on the table, wherein each of said forming tool units further includes locking means for changing and holding a circumferential position of each of said forming tool units while keeping each of said forming tool units directed toward the center of said table.

8. A wire forming apparatus for forming a wire guided in a feedout direction, said apparatus comprising:

a table having a substantially circular shape with a center and a surface substantially perpendicular to the feedout direction of the wire;

a forming tool unit disposed on said table, said forming tool unit including an independent pivot drive source creating a first drive force and a cam for converting the first drive force to a second force directed toward the center of said table, said forming tool unit also including a wire forming tool and a slider for holding said wire forming tool, said slider abutting against said cam and being slideably moveable toward the center of the table, wherein said forming tool unit being moveable about the center of said table to different circumferential positions on said table; and locking means for changing and holding a circumferential position of said forming tool unit while keeping said forming tool unit directing toward the center of said table.

* * * * *